United States Patent [19]

Walker et al.

[11] 4,194,868

[45] Mar. 25, 1980

[54] VALVE LIFTING ATTACHMENT FOR FORK LIFT

[76] Inventors: Leon P. Walker, 5420 Alvarado Pl., NE., Albuquerque, N. Mex. 87110; Manuel Gabaldon, 1711 Standord Dr. SE., Albuquerque, N. Mex. 87106

[21] Appl. No.: 918,830

[22] Filed: Jun. 26, 1978

[51] Int. Cl.[2] ..... B66F 9/06

[52] U.S. Cl. ..... 414/607; 414/608

[58] Field of Search ..... 414/607, 608, 266, 785; 294/84, 78 R, 81 R, 78 A; 187/9 R, 9 E; 24/230 R

[56] References Cited

U.S. PATENT DOCUMENTS

| | | | |
|---|---|---|---|
| 1,291,437 | 1/1919 | Desch | 294/81 R |
| 2,375,719 | 5/1945 | Wirkkala | 294/78 R |
| 2,719,643 | 10/1955 | McDonald | 414/607 |
| 2,721,757 | 10/1955 | Anderson | 294/81 R |
| 2,780,487 | 2/1957 | Bredensteiner et al. | 294/81 R |
| 2,892,230 | 6/1959 | Lopez | 294/78 |
| 3,067,889 | 12/1962 | Okonek | 414/266 |
| 3,264,026 | 8/1966 | Hansen | 294/2 |
| 3,751,008 | 8/1973 | McNatt | 414/607 |

FOREIGN PATENT DOCUMENTS

| | | | |
|---|---|---|---|
| 168187 | 9/1921 | United Kingdom | 294/78 R |

*Primary Examiner*—Stephen G. Kunin
*Assistant Examiner*—Lawrence E. Williams
*Attorney, Agent, or Firm*—Clarence O'Brien; Harvey B. Jacobson

[57] ABSTRACT

An elongated horizontal support member is provided for spanning and support from the horizontally spaced forks of a fork lift. The support member includes a plurality of longitudinally spaced anchor structures and a plurality of elongated flexible tension members have one set of corresponding ends thereof engaged with and supported from the anchor structures with the tension members swingably supported and depending downwardly therefrom. The other or lower set of corresponding ends of the tension members have fixtures supported therefrom for releasably engaging and supporting articles to be suspended from the support member by means of the tension members.

5 Claims, 5 Drawing Figures

VALVE LIFTING ATTACHMENT FOR FORK LIFT

BACKGROUND OF THE INVENTION

1. Field of the Invention

Fork lift trucks are utilized to lift and transport various heavy loads. However, most loads to be lifted and transported by fork lift trucks are supported on pallets specifically adapted to receive the horizontal forks of a fork lift truck thereunder. In addition, various industries utilize heavy equipment components which could be lifted and transported by fork lift trucks if some convenient means could be provided for supporting the equipment components from the forks of a fork lift truck. One form of heavy components which could be easily lifted and transported by a fork lift truck comprise heavy duty water valves, and the like. Accordingly, a need exists for structure adaptable to a fork lift truck and from which a plurality of heavy water valves, and the like, may be conveniently suspended.

2. Description of the Prior Art

Examples of various forms of fork lift truck attachments and other devices including some of the general structural and operational features of the instant invention are disclosed in U.S. Pat. Nos. 1,291,437, 2,719,643, 2,721,757, 3,264,026, 3,791,544 and 3,390,585.

BRIEF DESCRIPTION OF THE INVENTION

The lifting attachment of the instant invention comprises an elongated horizontal support member for spanning and support from the laterally spaced parallel forks of a fork lift truck. The support member includes a plurality of longitudinally spaced anchor structures and a plurality of elongated flexible link chain sections have one set of corresponding ends thereof engaged with and supported from the anchor structures with the other set of corresponding ends of the chain link sections dependingly supported from the anchor structures. The lower ends of the link chain sections have fixtures supported therefrom and each of the fixtures is adapted to removably engage an abutment carried by the operating stem of a heavy water valve.

The main object of this invention is to provide a lifting attachment for a fork lift truck whereby one or more heavy water valves may be lifted and transported by a fork lift truck.

Another object of this invention, in accordance with the preceding object, is to provide a fork lift truck attachment which will be capable of swingably suspending a plurality of heavy water valve assemblies therefrom in a safe manner.

Yet another object of this invention is to provide an attachment which may be readily supported from and anchored relative to the forks of a plurality of different makes of fork lift trucks.

A final object of this invention to be specifically enumerated herein is to provide a lifting attachment for the forks of a fork lift truck and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
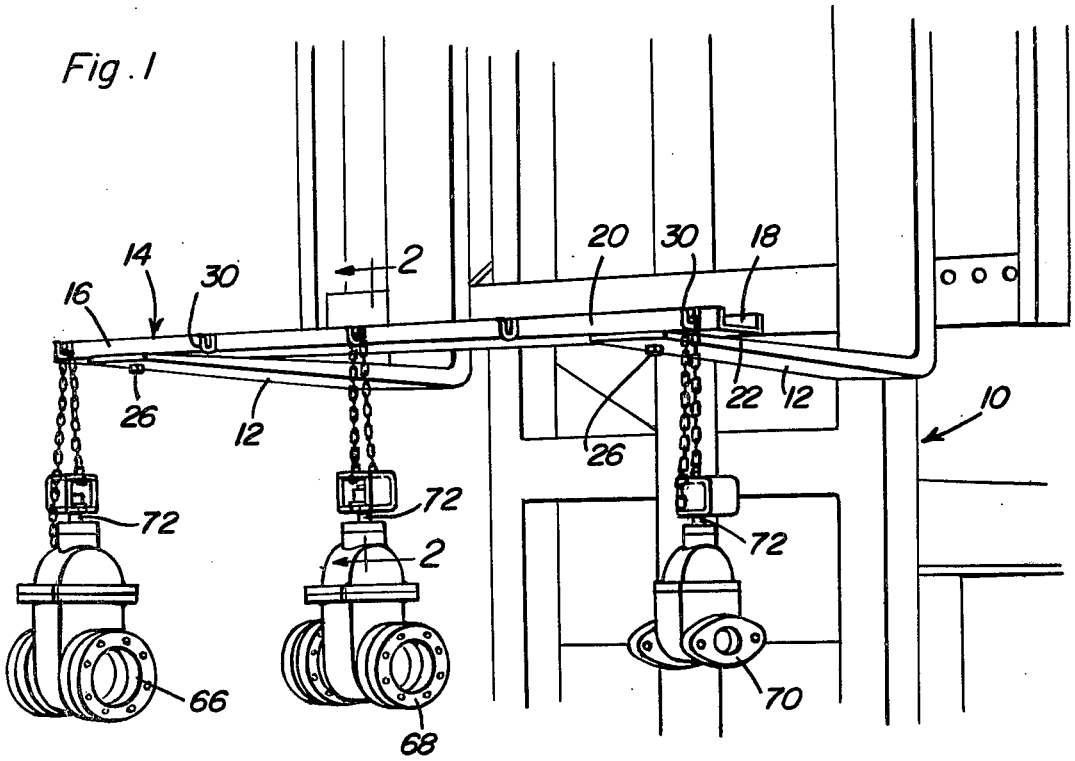
FIG. 1 is a fragmentary perspective view of the forward end portion of a conventional form of fork lift truck and with the lifting attachment of the instant invention operatively supported from the forks of the fork lift truck and being utilized to suspend three different types of water valve assemblies from the forks of the fork lift truck.

Referring now more specifically to the drawing, the numeral 10 generally designates a conventional form of fork lift truck including a pair of horizontal, laterally spaced apart and parallel vertically shiftable lifting forks 12.

The attachment of the instant invention is referred to in general by the reference numeral 14 and includes an elongated horizontal support member 16 comprising an upwardly opening channel member including a pair of upstanding opposite side flanges 18 and 20 interconnected by means of a lower bight portion 22 extending between and formed integrally with the lower marginal edge portions of the flanges 18 and 20.

The bight portion 22 includes a pair of longitudinally spaced apertures 24 formed therein and a pair of fasteners 26 may be secured through the apertures 24 as well as corresponding apertures 28 formed in the outer free ends of the forks 12 in order to semi-permanently attach the support member 16 to the forks 12 with the opposite ends of the support member 16 overlying the corresponding free end portions of the forks 12.

The flange 20 of the support member 16 includes a plurality of longitudinally spaced J-shaped upwardly opening grab hooks 30 secured to the outer side thereof in any convenient manner, such as by welding, and a plurality of link chain sections 32 have selected links 34 thereof engaged with the hooks 30 for support of the link chain sections 32 from the hooks 30.

The link chain sections 32 depend downwardly from the support member 16 and are swingably supported from the hooks 30. The lower link 36 of each link chain section 32 has a "cold shut" or anchor 40 supported therefrom. The anchor 40 includes a first leg 42 having an eye portion 38 at one end and terminating at its other end in a curved portion 44 terminating in a second leg 46. The free end of the second leg 46 terminates in a generally right angle terminal end 48 which may be passed through the eye portion 38 when the "cold shut" 40 is bent, in the area of curved portion 44, closed. The terminal end 48 may then be welded in the closed position extending through the eye 38 as at 49.

In addition, each of the anchors 40 supports a lifting fixture referred to in general by the reference numeral 50 therefrom. Each lifting fixture 50 comprises a generally square hollow housing including integrally formed top, bottom and rear walls 52, 54 and 56 with opposite side walls 58 and 60 extending and full welded between corresponding side marginal portions of the walls 52, 54 and 56, the front side of the housing 50 being open. In addition, the front marginal edge of the bottom wall 54 has a forwardly opening notch 62 formed therein and the forward marginal edge portion of the top wall 52 has an aperture 64 formed therein.

Figure 2:
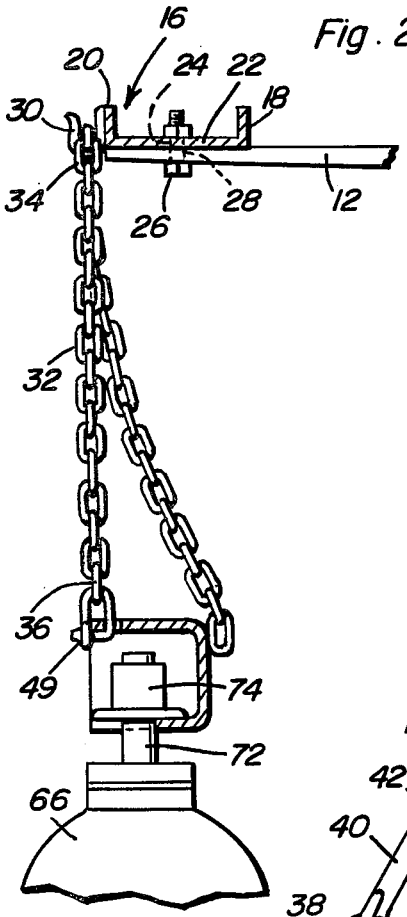
FIG.2 is an enlarged, fragmentary, vertical sectional view taken substantially upon a plane indicated by the section line 2—2 of FIG. 1.
Figure 3:
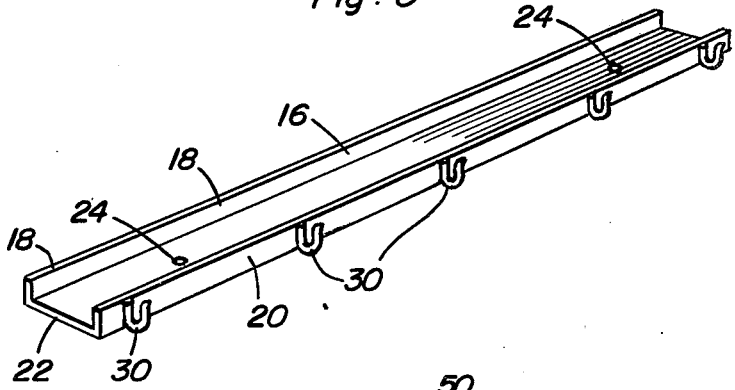
FIG. 3 is an enlarged, perspective view of the horizontal support member portion of the attachment.
Figure 4:
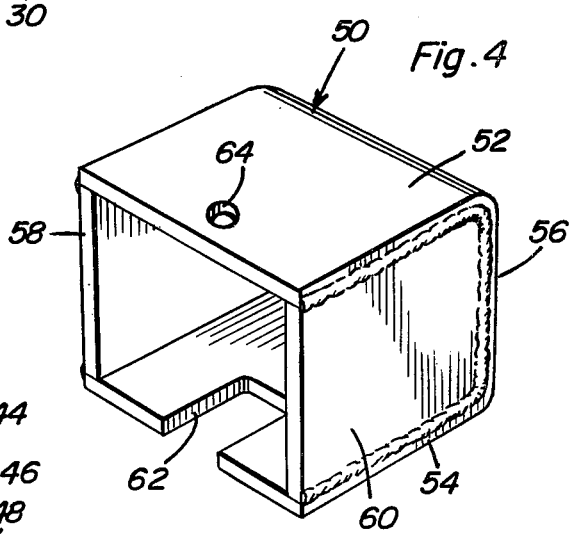
FIG. 4 is an enlarged, perspective view of one of the water valve engaging fixtures of the attachment.
Figure 5:
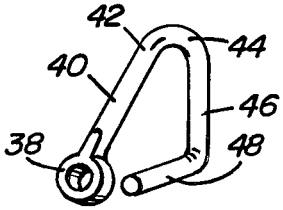
FIG. 5 is an enlarged, perspective view of one of the chain anchors by which the fixture illustrated in FIG. 4 may be anchored relative to the lower end of a link chain tension member of the attachment.

As may be seen from FIG. 2 of the drawing, the anchor 40 of each link chain section 32 is secured through the aperture 64 of the corresponding fitting 50 and the terminal end 48 of each anchor 40 is secured through the corresponding eye 38 and underlies and upwardly abuts against the undersurface of the forward marginal edge portion of the top wall 52 disposed between the aperture 64 and the forward edge of the top wall 52. In addition, each of a plurality of heavy water valve assemblies 66, 68 and 70 includes an upwardly projecting operating shank 72 and each operating shank 72 has an abutment 74 supported from its upper end portion. The fixtures 50 may each be engaged with a corresponding operating shank 72 below the corresponding abutment 74 in the manner illustrated in FIG. 2 of the drawing, with the shank 72 seated in the notch 62 and the underside of the abutment 74 downwardly abutted against the upper surface of the bottom wall 54. Assuming that the forks 12 of the truck 10 have been lowered to a height spaced above a corresponding water valve 66 less than the effective length of the corresponding link chain section 32, the fixture 50 supported from that link chain section 32 may be engaged with the operating shank 72 and abutment 74 of the associated water valve and the forks 12 of the truck 10 may then be elevated in order to lift the water valve with the latter supported from the forks 12 of the truck 10 by means of the attachment 14. One or more water valves may be supported from the forks 12 of the truck 10 in this manner and after the water valves have been lifted clear of a support surface, the truck 10 may be utilized to transport the water valves, safely, to a desired remote location. Of course, after the water valves have been transported to the desired location, the forks 12 of the truck 10 may be lowered in order to rest the water valves upon a suitable supporting surface after which the fixtures 50 may be disengaged from the valves.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A lifting attachment for a fork lift of the type including laterally spaced elongated horizontal lifting forks, said attachment including an elongated horizontal support member for spanning and support from said forks, said support member including a plurality of longitudinally spaced anchor means, a plurality of elongated flexible tension members including one set of corresponding ends thereof engaged with and supported from said anchor means with said tension members swingably supported from said anchor means and depending downwardly therefrom, the other set of corresponding ends of said tension members having fixture means supported therefrom adapted to releasably engage and support articles to be suspended from the support member by means of said tension members, the lower ends of said tension members having anchors supported therefrom, said fixture means each including a hollow open sided housing including top, bottom and rear walls as well as opposite side walls extending and interconnected between corresponding side marginal edges of said top, bottom and rear walls, the front sides of said housing being open, the front marginal edge portion of said lower wall having a forwardly opening notch formed therein, the front marginal edge portion of said top wall having a vertical aperture formed therethrough, said anchors including portions thereof passed through said apertures.

2. The combination of claim 1 wherein said anchor means comprise upwardly opening hooks carried by said support member, said one set of ends of said tension members including means releasably engaged with said hooks.

3. The combination of claim 2 wherein said tension members include link chain sections and said means on said one set of ends comprise individual links of said link chain sections releasably engaged with said hooks.

4. The combination of claim 1 wherein said support member comprises an upwardly opening channel member, said anchor means comprising upwardly opening grab hooks secured to one outer longitudinal side of said channel member.

5. The combination of claim 4 wherein said tension members include link chain sections and said means on said one set of ends comprise individual links of said link chain sections releasably engaged with said hooks.

* * * * *